US007616183B2

(12) United States Patent
Choi

(10) Patent No.: US 7,616,183 B2
(45) Date of Patent: Nov. 10, 2009

(54) SOURCE DRIVING CIRCUIT OF DISPLAY DEVICE AND SOURCE DRIVING METHOD THEREOF

(75) Inventor: Chang-Hwe Choi, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 628 days.

(21) Appl. No.: 11/298,913

(22) Filed: Dec. 9, 2005

(65) Prior Publication Data

US 2006/0146000 A1 Jul. 6, 2006

(30) Foreign Application Priority Data

Dec. 10, 2004 (KR) ..... 10-2004-0104087

(51) Int. Cl.
*G09G 3/36* (2006.01)

(52) U.S. Cl. ..... 345/100; 345/98; 345/99; 345/690

(58) Field of Classification Search ..... 345/98–100, 345/204, 690
See application file for complete search history.

(56) References Cited

U.S. PATENT DOCUMENTS 5,192,945 A * 3/1993 Kusada ..... 345/88
5,604,511 A * 2/1997 Ohi ..... 345/98
5,623,279 A * 4/1997 Itakura et al. ..... 345/98
5,900,853 A * 5/1999 Shimizu et al. ..... 345/98
5,903,250 A * 5/1999 Lee et al. ..... 345/100
6,049,321 A * 4/2000 Sasaki ..... 345/99
6,069,519 A * 5/2000 Song ..... 327/536
6,522,317 B1 * 2/2003 Satou et al. ..... 345/98
6,538,631 B1 * 3/2003 Kwon ..... 345/96
6,999,015 B2 * 2/2006 Zhang et al. ..... 341/144
7,064,695 B2 * 6/2006 Koo ..... 341/136
2004/0041601 A1 * 3/2004 Payne et al. ..... 327/143

FOREIGN PATENT DOCUMENTS

JP 199911249633 9/1999
JP 2000112444 4/2000
JP 20000200069 7/2000
JP 20030150126 5/2003
KR 19920022194 12/1992
KR 20040077016 9/2004

OTHER PUBLICATIONS

English Abstract***.
English Abstract of Publication No. 1992-22194.

* cited by examiner

*Primary Examiner*—Henry N Tran
*Assistant Examiner*—Viet Pham
(74) *Attorney, Agent, or Firm*—F. Chau & Assoc., LLC

(57) ABSTRACT

A source driving circuit includes a shift register, a data latch circuit, a D/A converter, and a sample-and-hold circuit. The shift register generates an n-bit first signal in response to a clock signal and an input/output control signal, wherein n is a positive integer. The data latch circuit samples video data using the first signal to latch the sampled video data, and outputs 3×n digital signals. The D/A converter generates a plurality of analog voltage signals corresponding to the 3×n digital signals using a plurality of gray scale voltages. The sample-and-hold circuit generates 6×n sample-and-hold signals using the analog voltage signals in response to a plurality of switching control signals.

16 Claims, 10 Drawing Sheets

SOURCE DRIVING CIRCUIT OF DISPLAY DEVICE AND SOURCE DRIVING METHOD THEREOF

CROSS-REFERENCE TO RELATED APPLICATIONS

This application claims priority to Korean Patent Application No. 2004-104087, filed on Dec. 10, 2004, the contents of which are herein incorporated by reference in its entirety.

BACKGROUND OF THE INVENTION

1. Field of the Invention

The present invention relates to a display device, and more particularly to a source driving circuit of a display device and a source driving method thereof.

2. Description of the Related Art

Compared with a cathode ray tube (CRT), a liquid crystal display (LCD) device is thin and has less weight with improved image quality. LCD devices are widely used for information processing devices such as laptop computers.

An active matrix LCD (AM LCD) device includes a plurality of active elements connected to pixel electrodes. The pixel electrodes are arranged in a matrix format. The AM LCD device has a higher contrast ratio than that of a passive matrix LCD device. Accordingly, the active matrix driving is used in color LCD devices. In AM LCD devices, thin film transistors (TFTs) are widely used as the active elements connected to the pixel electrodes.

FIG. 1 is a block diagram of a conventional AM LCD device, which is disclosed in Korean Patent Laid-Open Publication No. 10-2004-0077016. Referring to FIG. 1, the conventional AM LCD device includes a controller 100, a gate driving circuit 200, a source driving circuit 300, a liquid crystal panel 400, and a gray scale voltage generator 500.

The liquid crystal panel 400 includes TFTs located at the intersection of each row and column of the matrix. The TFT has a source receiving a source signal (or "data signal") and a gate receiving a gate signal (or "scan signal"). A storage capacitor CST and a liquid crystal capacitor CLC are connected between a drain of the TFT and a common voltage VCOM. The liquid crystal panel 400 receives the gate signals through gate lines G1 to Gn, and the source signals through source lines D1 to Dm, respectively. The gate driving circuit 200 produces the gate signals by combining a gate-on voltage Von and a gate-off voltage Voff, and applies the gate signals to the gate lines G1 to Gn.

The gray scale voltage generator 500 generates positive and negative gray scale voltages GMA associated with the brightness controls of the LCD device.

The source driving circuit 300 performs a digital-to-analog (D/A) conversion on video data DATA received from the controller 100 using the gray scale voltages GMA outputted from the gray scale voltage generator 500, and applies the converted data to the source lines D1 to Dm.

The controller 100 receives RGB video signals R, G and B and control signals, such as a vertical sync signal Vsync, a horizontal sync signal Hsync, a main clock signal MCLK, a data enable signal DE, and so on. Based on the control signals, the controller 100 generates source control signals CONT1 and gate control signals CONT2, and processes the RGB video signals R, G and B to meet the proper operating conditions of the liquid crystal panel 400. Then, the controller 100 transmits the gate control signals CONT2 to the gate driving circuit 200, and transmits the source control signals CONT1 and the video data DATA to the source driving circuit 300.

The gate driving circuit 200 and the source driving circuit 300 include a plurality of gate drive integrated circuits (ICs) (not shown) and a plurality of source drive ICs (not shown), respectively. The source driving circuit 300 applies the source signals to the source lines arranged on the liquid crystal panel 400, and the gate driving circuit 200 applies the gate signals to the gate lines arranged on the liquid crystal panel 400.

FIG. 2 is a block diagram of a source driving circuit of an LCD device. As shown in FIG. 2, the source driving circuit includes ten source drive ICs 310, 320, 330, 340, 350, 360, 370, 380, 390 and 395. Each of the source drive ICs receives video data DATA, gray scale voltage GMA, and control signals DIO, CLK and TP. The control signal DIO is an I/O control signal representing a data input/output direction in the source drive IC; data is inputted to a left side of the source drive IC and outputted through a right side thereof in response to the control signal DIO, and vice versa. The control signal CLK is a clock signal used in the source drive IC. The control signal TP is a load signal determining whether the data DATA of the source drive IC is to be output.

FIG. 3 is a block diagram of one source drive IC (for example, 310) of the source driving circuit illustrated in FIG. 2. Referring to FIG. 3, the source drive IC 310 includes a shift register 311, a data latch circuit 313, a D/A converter 315, and an output buffer 317. The shift register 311 receives the clock signal CLK with a predetermined frequency and the I/O control signal DIO, and it generates a pulse signal at every time interval of a predetermined number of clock signals. The data latch circuit 313 receives the data DATA and the load signal TP from the controller 100 of FIG. 1. The data latch circuit 313 latches the data DATA according to the shift order of the shift register 311 and outputs the latched data DATA when the load signal TP is applied thereto.

The D/A converter 315 receives the gray scale voltage GMA from the gray scale voltage generator 500 of FIG. 1 and generates analog voltage signals S1 to S414 in response to the output signals D1 to D414 of the data latch circuit 313. The analog voltage signals S1 to S414 are applied to the output buffer 317. The output buffer 317 outputs signals Y1 to Y414 to the source lines according to the order of the data DATA applied to the data latch circuit 313.

As shown in FIG. 3, the source drive IC 310 outputs 414 source signals Y1 to Y414. The shift register 311 is a 138-bit register and the data latch circuit 313 has 414 (138×3=414) channels with respect to the video signals R, G and B.

The conventional source drive IC illustrated in FIG. 3 uses the 138-bit shift register 311 to output 414 source signals, and 414 data are simultaneously converted into the analog signals in response to the load signal TP received from the timing controller 100 of FIG. 1. In the conventional source driving circuit with the source drive ICs of FIG. 3, the circuit size of the D/A converter 315 is large and the layout area is large when it is implemented as the semiconductor IC. In addition, the conventional source driving circuit consumes a large amount of power. It would be desirable that a source driving circuit of an LCD device be capable of generating the source signals Y1 to Y414 with low power consumption.

SUMMARY OF THE INVENTION

Example embodiments of the present invention provide a source driving circuit of a display device and a source driving method of a display device, which can reduce a chip size and power consumption using a sample-and-hold technique.

In an example embodiment of the present invention, a source driving circuit of a display device includes a shift register, a data latch circuit, a D/A converter, and a sample-and-hold circuit.

The shift register generates an n-bit first signal in response to a clock signal and an input/output control signal, wherein n is a positive integer. The data latch circuit samples video data using the first signal to latch the sampled video data, and outputs 3×n digital signals. The D/A converter generates a plurality of analog voltage signals corresponding to the 3×n digital signals using a plurality of gray scale voltages. The sample-and-hold circuit generates 6×n sample-and-hold signals using the analog voltage signals in response to a plurality of switching control signals.

In one aspect of the invention, a display device includes a controller, a gate driving circuit, and a source driving circuit.

The controller generates a plurality of gate control signals, a clock signal, a plurality of input/output control signals, a load signal, and a sample-and-hold control signal. The gate driving circuit generates a plurality of gate signals in response to the gate control signals and supplies the gate signals to gate lines of a display panel. The source driving circuit includes a shift register, a data latch circuit, a D/A converter, and a sample-and-hold circuit.

The shift register generates an n-bit first signal in response to the clock signal and the input/output control signal, n being a positive integer. The data latch circuit is configured to sample video data using the first signal to latch the sampled video data, and is configured to output 3×n digital signals. The D/A converter is configured to generate a plurality of analog voltage signals corresponding to the 3×n digital signals using gray scale voltages. The sample-and-hold circuit generates 6×n second signals using the analog voltage signals in response to a plurality of switching control signals.

In an example embodiment of the present invention, a source driving method of a display device includes: generating an n-bit first signal in response to a clock signal and an input/output control signal, n being a positive integer; sampling video data by using the first signal and latching the sampled video data to output 3×n digital signals; generating a plurality of analog voltage signals corresponding to the 3×n digital signals using a plurality of gray scale voltages; and generating 6×n sample-and-hold signals using the analog voltage signals in response to a plurality of switching control signals.

BRIEF DESCRIPTION OF THE DRAWINGS

The present invention will become more apparent to those of ordinary skill in the art when descriptions of example embodiments thereof are read with reference to the accompanying drawings, of which.

DETAILED DESCRIPTION OF THE EXAMPLE EMBODIMENTS

Hereinafter, the example embodiments of the present invention will be described in detail with reference to the accompanying drawings.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Figure 4:
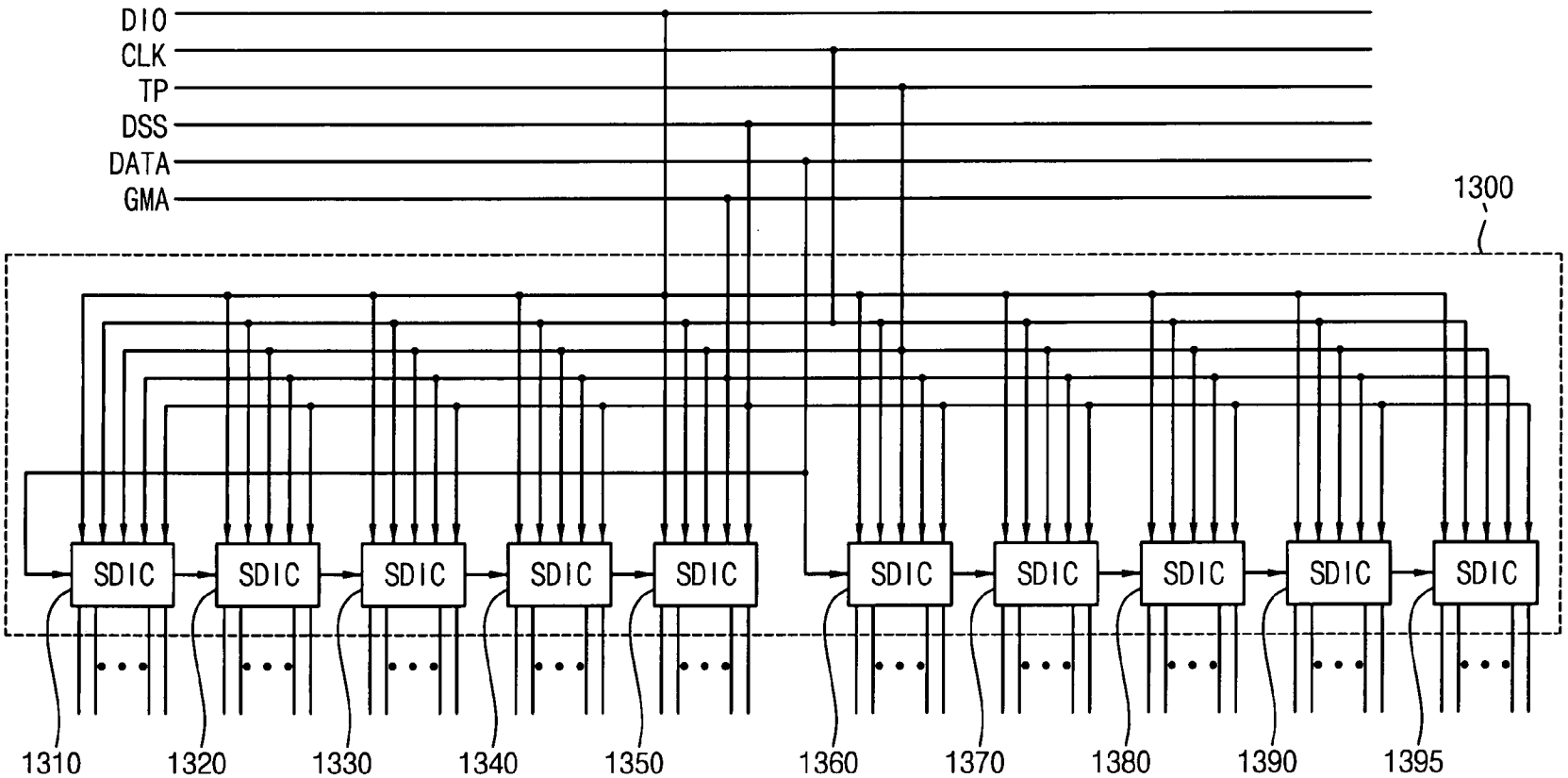
FIG. 4 is a block diagram of a source driving circuit of an LCD device according to an example embodiment of the present invention.

FIG. 4 is a block diagram of a source driving circuit of an LCD device according to an example embodiment of the present invention. Referring to FIG. 4, the source driving circuit 1300 includes source drive ICs 1310, 1320, 1330, 1340, 1350, 1360, 1370, 1380, 1390 and 1395. It is to be understood that ten source drive ICs are illustrated in FIG. 4 for the purposes of example only, and embodiments of the source driving circuit may include an arbitrary number of source drive ICs. Each of the source drive ICs receives video data DATA, a gray scale voltage GMA, and control signals DIO, CLK, TP and DSS. The control signal DIO is an I/O control signal representing a data input/output direction in the source drive IC. For example, data is inputted to a left side of the source drive IC and outputted through a right side thereof in response to the control signal DIO, and vice versa. The control signal CLK is a clock signal used in the source drive IC. The control signal TP is a load signal determining whether the data DATA of the source drive IC is to be output. The control signal DSS is a sample-and-hold control signal. Each of the source drive ICs illustrated in FIG. 4 includes 144 source lines.

Figure 5:
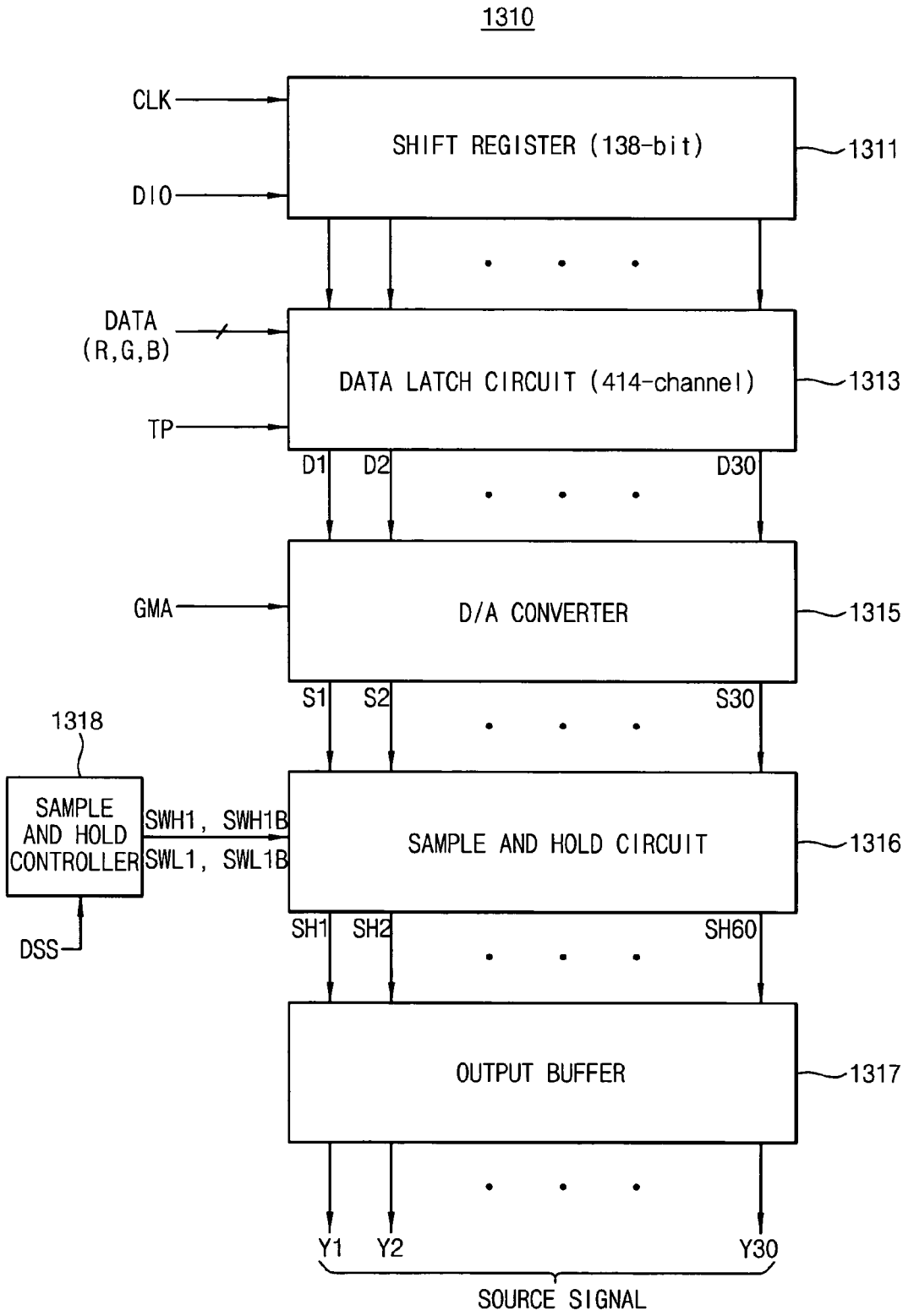
FIG. 5 is a block diagram of an example source drive IC of the source driving circuit illustrated in FIG. 4.

FIG. 5 is a block diagram of an example source drive IC of the source driving circuit illustrated in FIG. 4. Referring to FIG. 5, the source drive IC 1310 includes a shift register 1311, a data latch circuit 1313, a D/A converter 1315, a sample-and-hold circuit 1316, an output buffer 1317, and a sample-and-hold controller 1318.

The shift register 1311 receives the clock signal CLK with a predetermined frequency and the I/O control signal DIO, and it generates a pulse signal at every time interval of a predetermined number of clock signals. The data latch circuit 1313 receives the video data DATA and the load signal TP. The data latch circuit 1313 latches the video data DATA according to the shift order of the shift register 1311 and outputs the latched data DATA when the load signal TP is applied thereto.

The D/A converter 1315 generates analog voltage signals S1 to S30 corresponding to output signals D1 to D30 of the data latch circuit 313 by using the gray scale voltage GMA. The analog voltage signals S1 to S30 outputted from the D/A converter 1315 are applied to the sample-and-hold circuit 1316. The sample-and-hold circuit 1316 generates sample-and-hold output signals SH1 to SH60 in response to the output signals S1 to S30 of the D/A converter 1315 under control of switching control signals SWH1, SWH1B, SWL1 and SWL1B. The sample-and-hold controller 1318 receives the sample-and-hold control signal DSS and generates the switching control signals SWH1, SWH1B, SWL1 and SWL1B. The output buffer 1317 buffers and selects the sample-and-hold output signals SH1 to SH60 and generates signals Y1 to Y30. The output buffer 1317 outputs the signals Y1 to Y30 to the source lines according to the order of the video data DATA applied to the data latch circuit 1313.

Hereinafter, the operation of the source driving circuit of the LCD device according to an example embodiment of the present invention will be described with reference to FIGS. 4 and 5.

Referring to FIG. 4, the source driving circuit 1300 includes ten source drive ICs 1310, 1320, 1330, 1340, 1350, 1360, 1370, 1380, 1390 and 1395. Each of the source drive ICs receives the video data DATA, the gray scale voltage GMA, and the control signals DIO, CLK, TP and DSS. In the source driving circuit 1300, the five source drive ICs 1310, 1320, 1330, 1340 and 1350 located at the left side and the five source drive ICs 1360, 1370, 1380, 1390 and 1395 located at the right side are operated independently. When the source drive IC 1310 processes the video data DATA and supplies the source signals to the source lines, the source drive IC 1360 also processes the video data DATA and supplies the source signals to the source lines.

In response to the I/O control signal DIO, the data are inputted through the left side of the source drive IC and outputted through the right side thereof, or, alternatively, the data are inputted through the right side of the source drive IC and outputted through the left side thereof. In the source driving circuit illustrated in FIG. 4, the video data DATA are inputted through the left side of the source drive IC and outputted through the right side thereof.

In the source driving circuit illustrated in FIG. 4, the video data DATA are inputted to the left side of the source drive IC 1310 and outputted through the right side thereof. The video data DATA outputted through the right side of the source drive IC 1310 are inputted to the left side of the source drive IC 1320 and outputted through the right side thereof. The video data DATA outputted through the right side of the source drive IC 1320 are inputted to the left side of the source drive IC 1330 and outputted through the right side thereof. The video data DATA outputted through the right side of the source drive IC 1330 are inputted to the left side of the source drive IC 1340 and outputted through the right side thereof. The video data DATA outputted through the right side of the source drive IC 1340 are inputted to the left side of the source drive IC 1350.

Similarly, the video data DATA are inputted to the left side of the source drive IC 1360 and outputted through the right side thereof. The video data DATA outputted through the right side of the source drive IC 1360 are inputted to the left side of the source drive IC 1370 and outputted through the right side thereof. The video data DATA outputted through the right side of the source drive IC 1370 are inputted to the left side of the source drive IC 1380 and outputted through the right side thereof. The video data DATA outputted through the right side of the source drive IC 1380 are inputted to the left side of the source drive IC 1390 and outputted through the right side thereof. The video data DATA outputted through the right side of the source drive IC 1390 are inputted to the left side of the source drive IC 1395.

The source driving circuit of the LCD device, according to an example embodiment of the present invention, performs signal processing fourteen times, on 30 channels at a time, and outputs source signals of 414 channels.

Referring to FIG. 5, the shift register 1311 outputs a 10-bit pulse signal. The data latch circuit 1313 latches the RGB video data DATA and outputs the digital signals D1 to D30 through the 30 channels under the control of the load signal TP.

Figure 6:
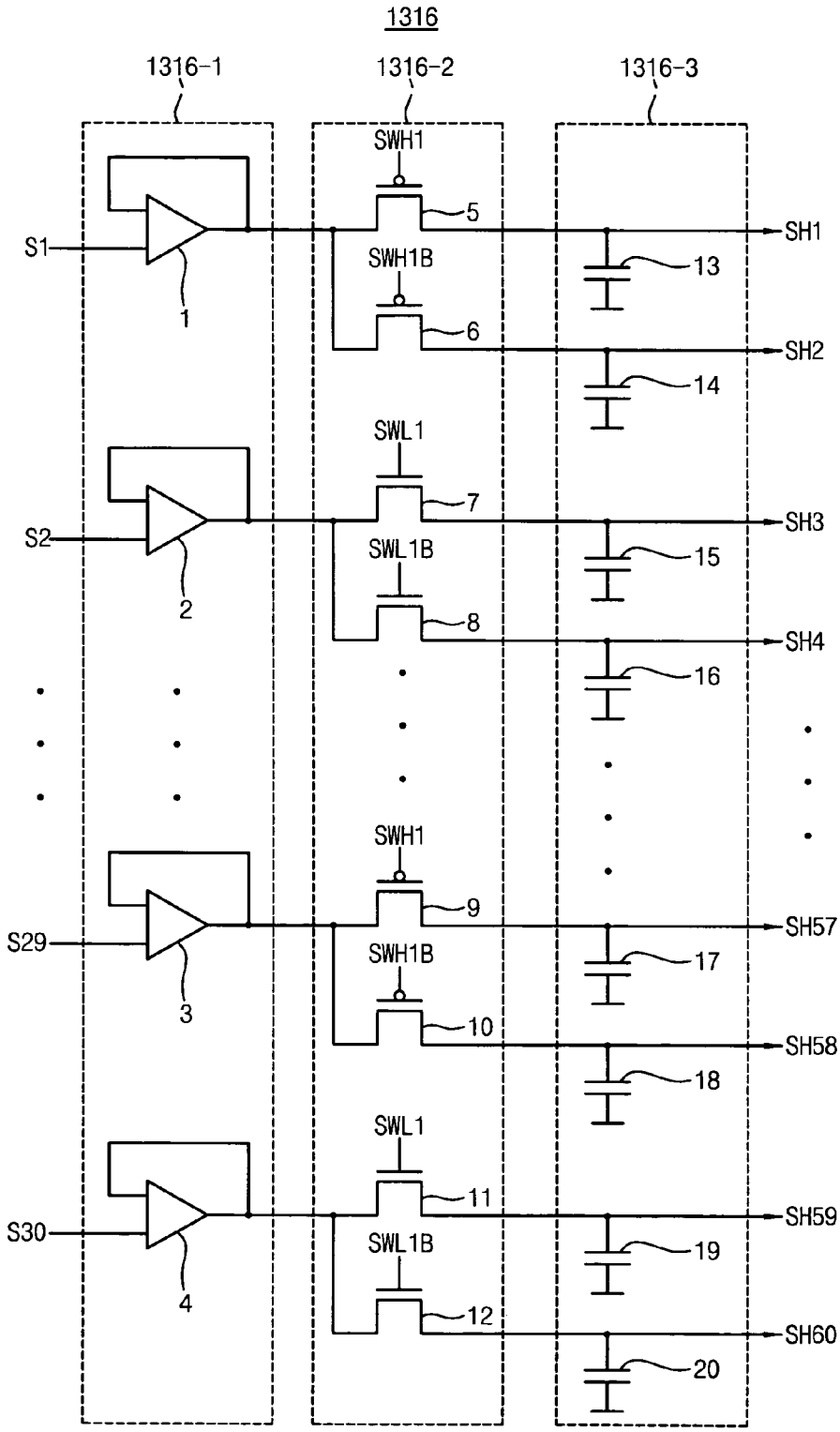
FIG. 6 is a circuit diagram of a sample-and-hold circuit of the source drive IC illustrated in FIG. 5, according to an example embodiment of the present invention.

FIG. 6 is a circuit diagram of an example embodiment of the sample-and-hold circuit 1316 included in the source drive IC illustrated in FIG. 5. Referring to FIG. 6, the sample-and-hold circuit 1316 includes a buffer circuit 1316-1, a switching circuit 1316-2, and a storage circuit 1316-3.

The buffer circuit 1316-1 is configured with buffers 1 to 4 and buffers the output signals S1 to S30 of the D/A converter 1315 illustrated in FIG. 5, improving the current drivability. The buffer circuit 1316-1 may include a plurality of voltage followers. The switching circuit 1316-2 is configured with switches 5 to 12 and transmits the output signals of the buffer circuit 1316-1 to the storage circuit 1316-3 in response to the switching control signals SWH1, SWH1B, SWL1 and SWL1B. The switches 5 to 12 may include PMOS transistors or NMOS transistors. The storage circuit 1316-3 is configured with capacitors 13 to 20, and stores electric charges corresponding to the output signals S1 to S30 of the D/A converter 1315 illustrated in FIG. 5 and outputs the sample-and-hold output signals SH1 to SH60.

The operation of the sample-and-hold circuit 1316 illustrated in FIG. 6 will be described below.

As described above, the source drive IC 1310 according to an example embodiment of the present invention as illustrated in FIG. 5, performs signal processing fourteen times, on 30 channels at a time, and generates 414 source signals. Referring to FIG. 6, the 30 output signals S1 to S30 of the D/A converter 1315 illustrated in FIG. 5 are buffered through one buffer of the buffer circuit 1316-1. The analog signals buffered in the buffer circuit 1316-1 are outputted to the storage circuit 1316-3 in response to the switching control signals SWH1, SWH1B, SWL1 and SWL1B.

For example, when the switching control signals SWH1 and SWH1B are logic "LOW" and logic "HIGH", respectively, the PMOS transistors 5 and 9 are turned on and the PMOS transistors 6 and 10 are turned off. In addition, when the switching control signals SWL1 and SWL1 B are logic "LOW" and logic "HIGH", respectively, the NMOS transistors 7 and 11 are turned off and the NMOS transistors 8 and 12 are turned on. The capacitors 13, 16, 17 and 20 are charged by the output signals of the buffer circuit 1316-1.

When the switching control signals SWH1 and SWH1B are logic "HIGH" and logic "LOW", respectively, the PMOS transistors 5 and 9 are turned off and the PMOS transistors 6 and 10 are turned on. In addition, when the switching control signals SWL1 and SWL1 B are logic "HIGH" and logic "LOW", respectively, the NMOS transistors 7 and 11 are turned on and the NMOS transistors 8 and 12 are turned off. The capacitors 14, 15, 18 and 19 are charged by the output signals of the buffer circuit 1316-1, and the output buffer 1317 illustrated in FIG. 5 is driven by the voltages stored in the capacitors 13, 16, 17 and 20 at the previous cycle.

Figure 7:
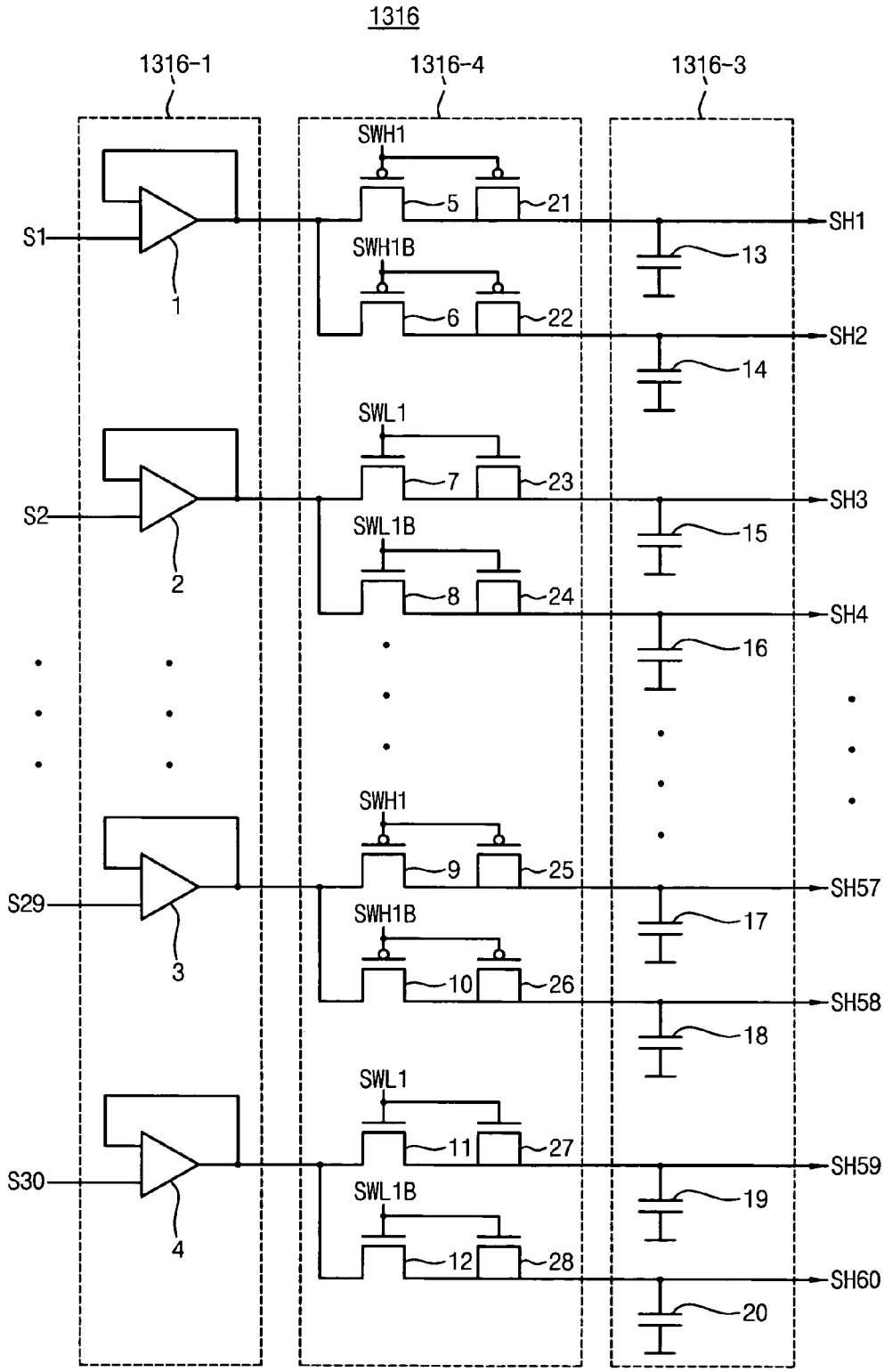
FIG. 7 is a circuit diagram of a sample-and-hold circuit of the source drive IC illustrated in FIG. 5, according to another example embodiment of the present invention.

FIG. 7 is a circuit diagram of a sample-and-hold circuit 1316 of the source drive IC illustrated in FIG. 5, according to another example embodiment of the present invention. The circuit configuration shown in FIG. 7 is similar to that of FIG. 6, except that the switching circuit 1316-4 is different than the switching circuit 1316-2 of FIG. 6. Referring to FIG. 7, the sample-and-hold circuit 1316 includes a buffer circuit 1316-1, a switching circuit 1316-4, and a storage circuit 1316-3.

The buffer circuit 1316-1 is configured with buffers 1 to 4 and buffers the output signals S1 to S30 of the D/A converter 1315 illustrated in FIG. 5, improving the current drivability. The switching circuit 1316-4 is configured with switches 5 to 12 and MOS capacitors 21 to 28 serially connected thereto, respectively. The MOS capacitor and the corresponding switch operate in response to the same switching control signal. The switching circuit 1316-4 transmits the output signals of the buffer circuit 1316-1 to the storage circuit 1316-3 in response to the switching control signals SWH1, SWH1B, SWL1 and SWL1B. The storage circuit 1316-3 is configured with capacitors 13 to 20, and it stores electric charges corresponding to the output signals S1 to S30 of the D/A converter 1315, as illustrated in FIG. 5, and outputs the sample-and-hold output signals SH1 to SH60.

As previously noted, the circuit configuration shown in FIG. 7 is similar to that of FIG. 6, except that the switching circuit 1316-4 is different than the switching circuit of FIG. 6. In the interests of clarity and brevity, the following description will address the operation of the switching circuit 1316-4.

Referring to FIG. 7, the switching circuit 1316-4 includes a plurality of MOS transistors 5 to 12 configured to perform switching operations in response to the switching control signals SWH1, SWH1B, SWL1 and SWL1B, and a plurality of MOS capacitors 21 to 28 serially connected to the MOS transistors 5 to 12.

When the MOS transistors 5 to 12 are turned off, the MOS capacitors 21 to 28 absorb electric charges remaining in parasitic capacitors formed between gates and drains of the transistors 5 to 12, or between gates and sources thereof. Accordingly, if the MOS capacitors 21 to 28 are serially connected to the MOS transistors 5 to 12, when the MOS transistors 5 to 12 are turned on, errors are not mixed with data (voltages) charged in the capacitors 13 to 20.

Figure 8:
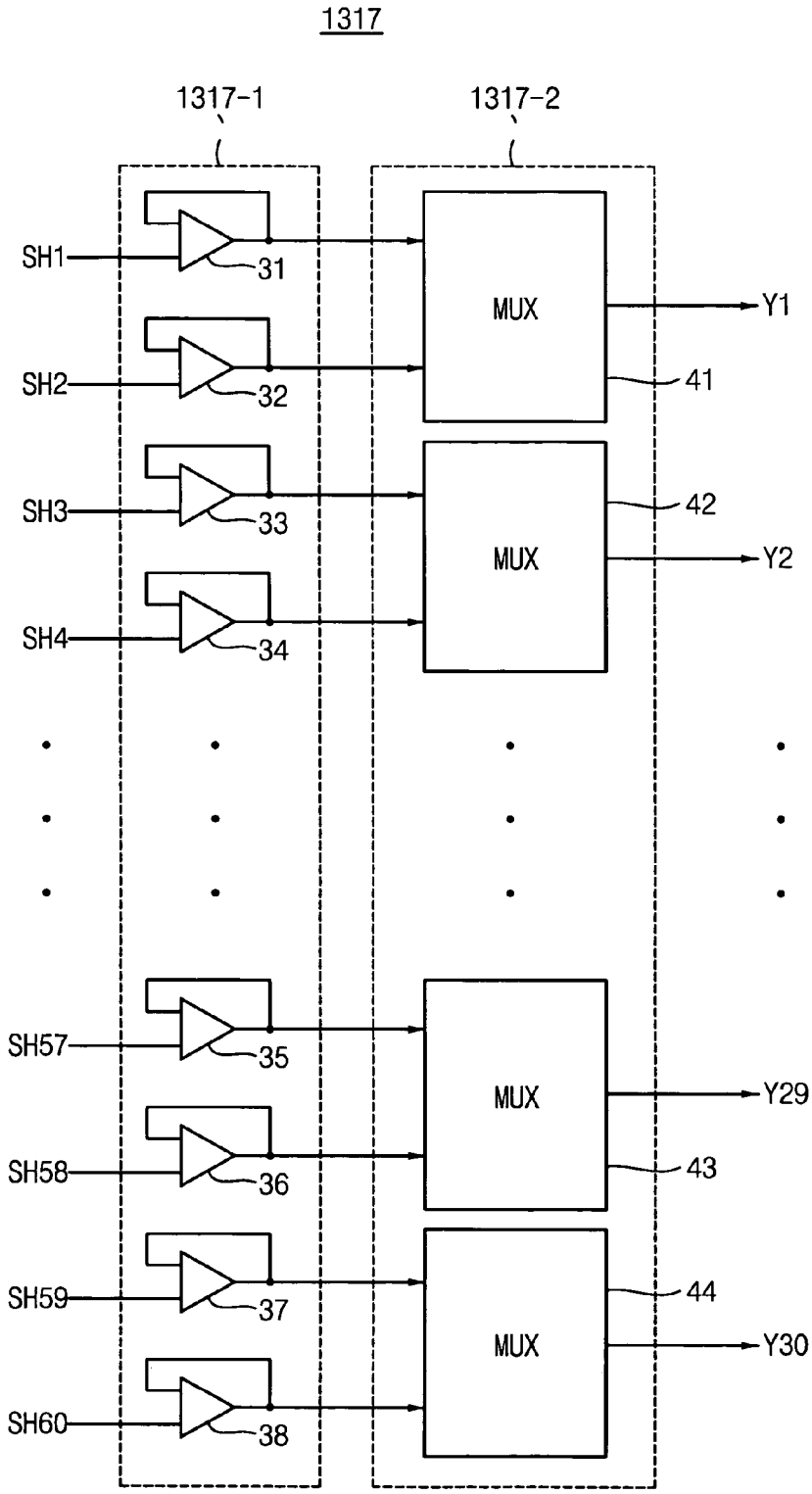
FIG. 8 is a circuit diagram of an output buffer of the source drive IC illustrated in FIG. 5.

FIG. 8 is a circuit diagram of the output buffer 1317 of the source drive IC illustrated in FIG. 5, according to an example embodiment of the present invention. Referring to FIG. 8, the output buffer 1317 includes a buffer circuit 1317-1 and a selecting circuit 1317-2.

The buffer circuit 1317-1 is configured with buffers 31 to 38 and buffers the output signals SH1 to SH60 of the sample-and-hold circuit 1316, improving the current drivability. The selecting circuit 1317-2 is configured with multiplexers 41 to 44, and selectively outputs the buffered output signals SH1 to SH60 of the sample-and-hold circuit 1316.

Hereinafter, the operation of the output buffer 1317 will be described with reference to FIG. 8.

Referring to FIG. 8, the multiplexer 41 selects one of the buffered output signals, SH1 or SH2, of the sample-and-hold circuit 1316 and outputs the selected signal as the source signal Y1. The multiplexer 42 selects one of the buffered output signals, SH3 or SH4, of the sample-and-hold circuit 1316 and outputs the selected signal as the source signal Y2. In a similar manner, the multiplexer 43 selects one of the buffered output signals, SH57 or SH58, of the sample-and-hold circuit 1316 and outputs the selected signal as the source signal Y29. The multiplexer 44 selects one of the buffered output signals, SH59 or SH60, of the sample-and-hold circuit 1316 and outputs the selected signal as the source signal Y30.

Figure 9A:
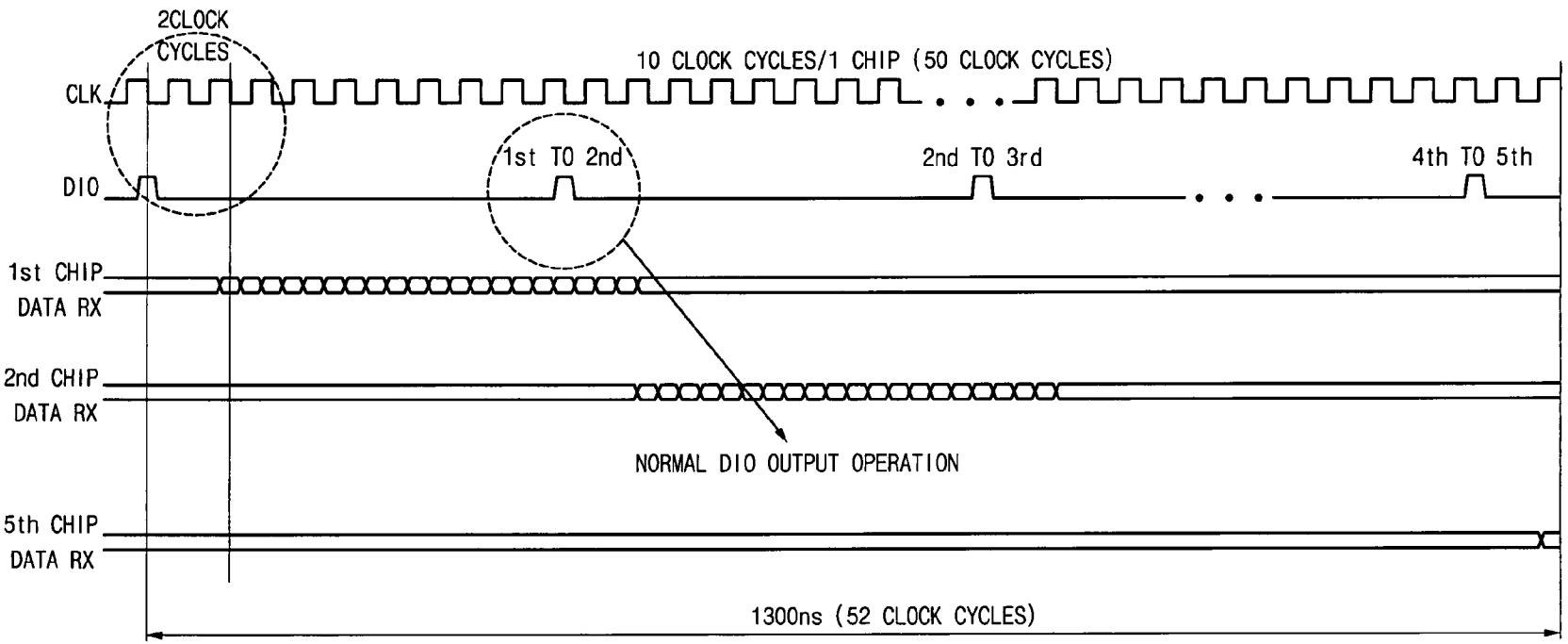
FIGS. 9A and 9B are operation timing diagrams of the example source drive IC illustrated in FIG. 5.
Figure 9B:
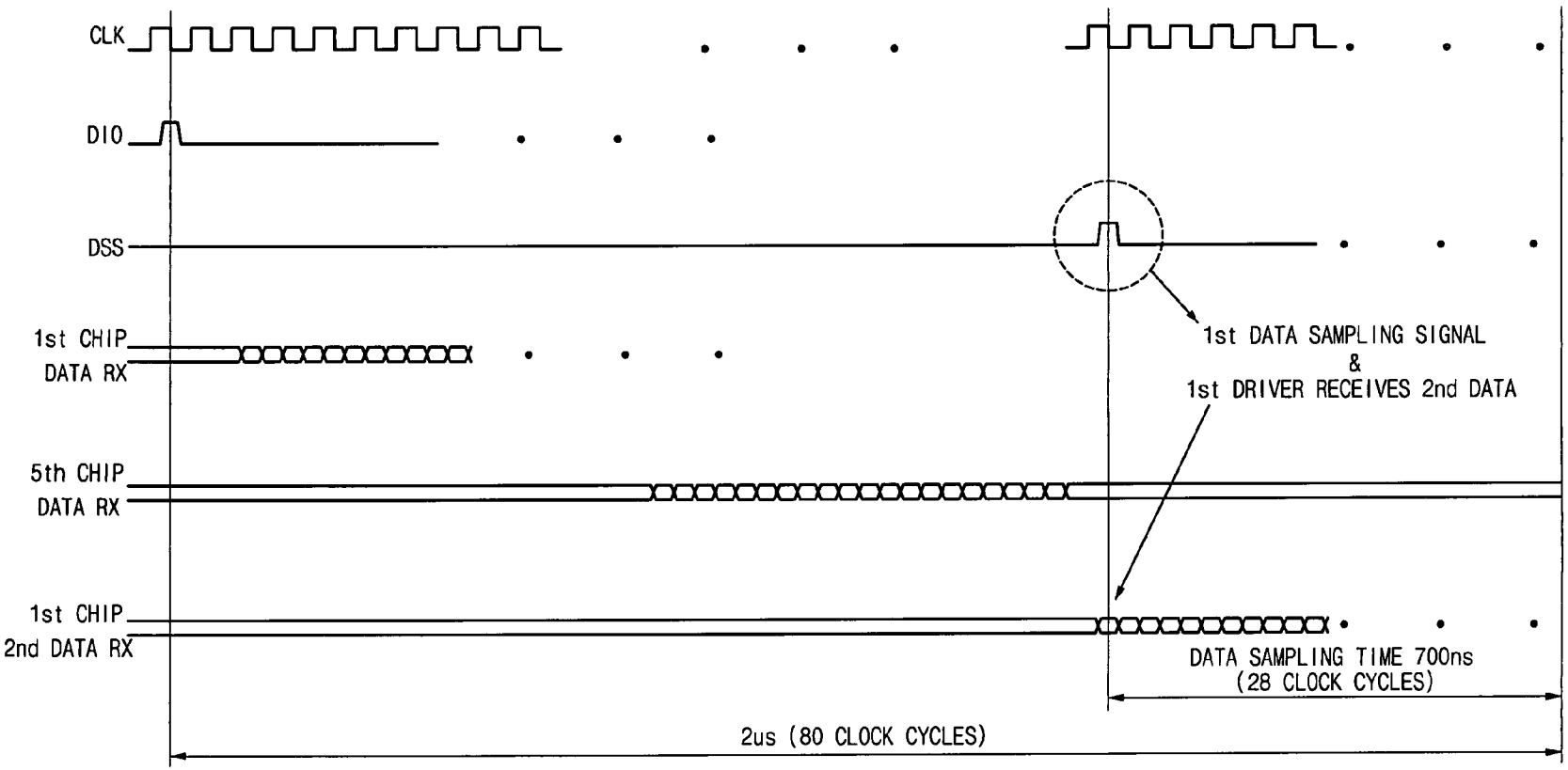

FIGS. 9A and 9B are operation timing diagrams of the example source drive IC illustrated in FIG. 5. As described above with reference to FIG. 4, the operations of the five source drive ICs 1310, 1320, 1330, 1340 and 1350 located at the left side of the source driving circuit 1300 are symmetrical with the operations of the five source drive ICs 1360, 1370, 1380, 1390 and 1395 located at the right side of the source driving circuit 1300.

Referring to FIG. 9A, the source drive ICs start to operate in response to the I/O control signal DIO. When the I/O control signal DIO is inputted, the first to fifth source drive ICs receive the video data. For the purposes of example only, as depicted in FIG. 9A, it takes 10 clock cycles for one source drive IC to receive the video data. Accordingly, it takes 50 clock cycles for all five source drive ICs to receive the video data. In addition, it takes 2 clock cycles, for example, for the first source drive IC to start to receive the video data after the I/O control signal DIO is initially generated. Accordingly, it takes 52 clock cycles (1300 ns) for all five source drive ICs to receive the video data after the I/O control signal DIO is initially generated.

Referring to FIG. 9B, after the first to fifth source drive ICs receive the video data, the sample-and-hold control signal DSS is generated. If the sample-and-hold control signal DSS is generated, the D/A converted signals are sampled in the respective source drive ICs. Then, the first to fifth source drive ICs receive the video data. For example, the reception of the video data may require 52 clock cycles and the data sampling requires 28 clock cycles (700 ns). Therefore, it takes 80 clock cycles (2 μs) to receive and then sample the video data. In the source driving circuit of the LCD device, according to an example embodiment of the present invention, data reception and sampling operations are performed fourteen times, on 30 source signals at a time, to generate the 414 source signals. Accordingly, a total time (t) necessary for the five source drive ICs to receive and sample the video data can be calculated as: $t=1.3\ \text{us}\times 14+700\ \text{ns}=18.9\ \mu\text{s}$. Because it takes 20 μs to scan one picture, the source driving circuit according to an example embodiment of the present invention may be able to generate the source signals. The source driving circuit generates the 414 source signals by performing, fourteen times, the operation of generating 30 source signals at a time. The D/A converter configured with the decoders and the string resistors, according to an example embodiment of the present invention, may be 30% of the size of the conventional D/A converter. In addition, the sizes of the shift register and the data latch circuit may be significantly reduced as compared with the related art.

Figure 1:
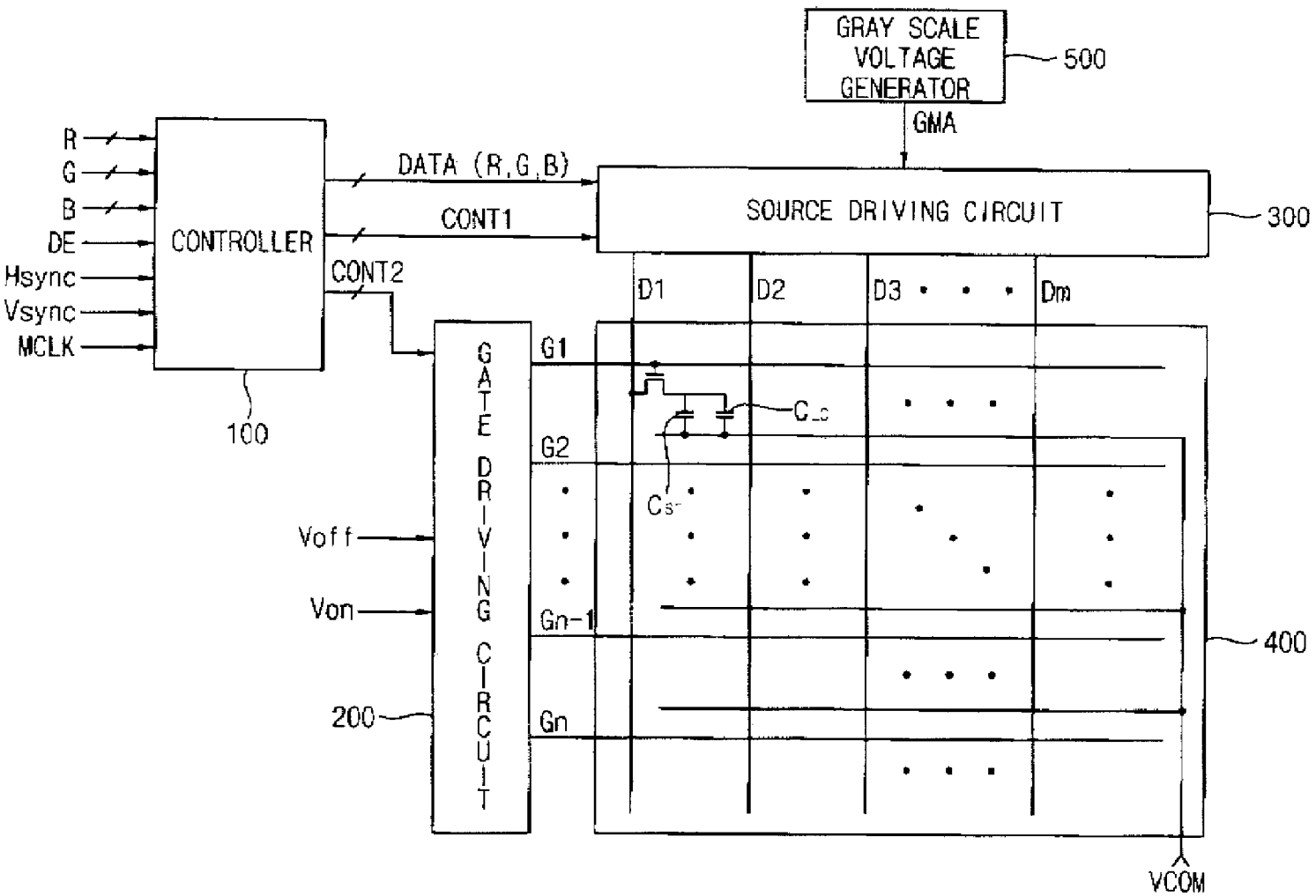
FIG. 1 (PRIOR ART)
FIG. 1 is a block diagram of a conventional AM LCD device.
Figure 2:
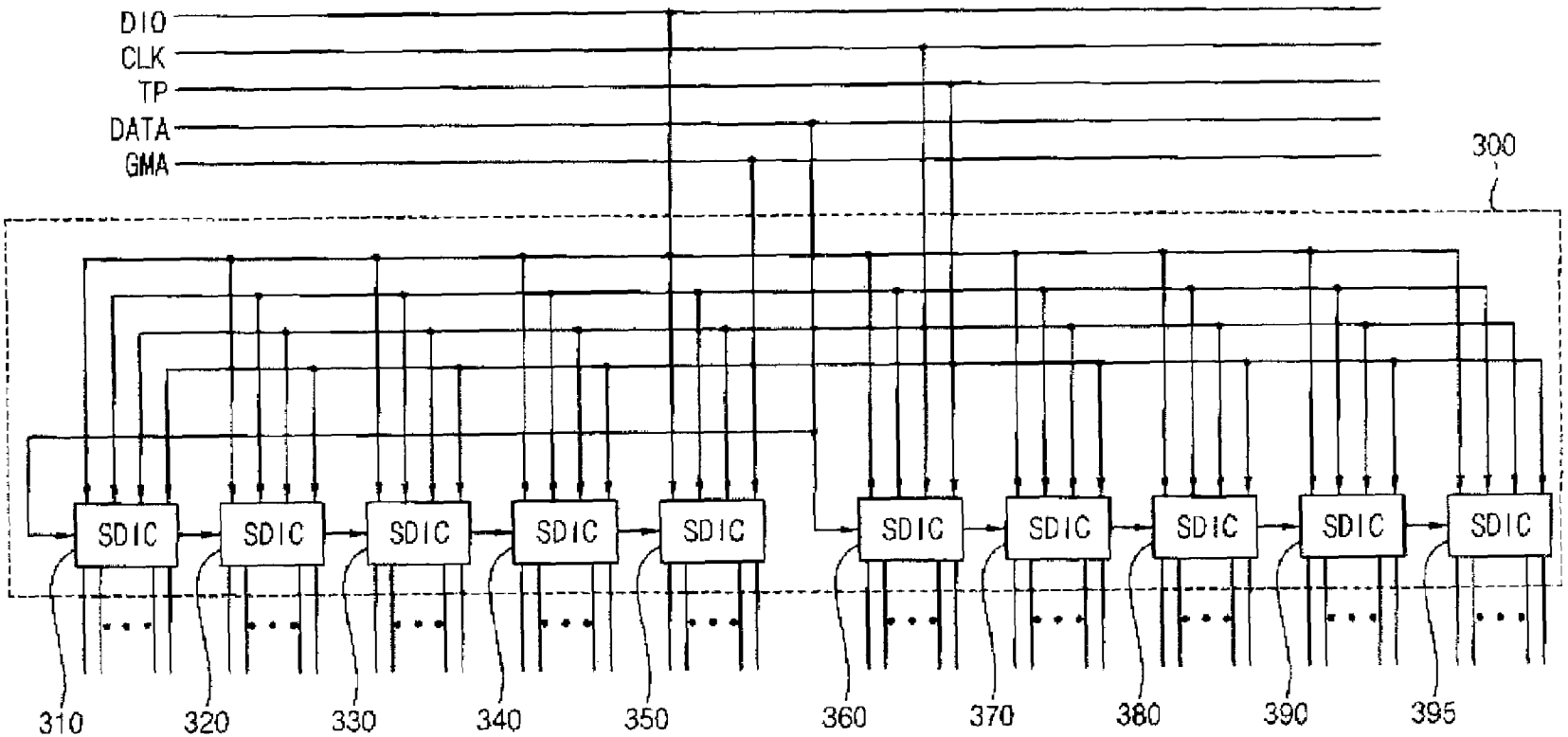
FIG. 2 (PRIOR ART)
FIG. 2 is a block diagram of a source driving circuit of a conventional LCD device.
Figure 3:
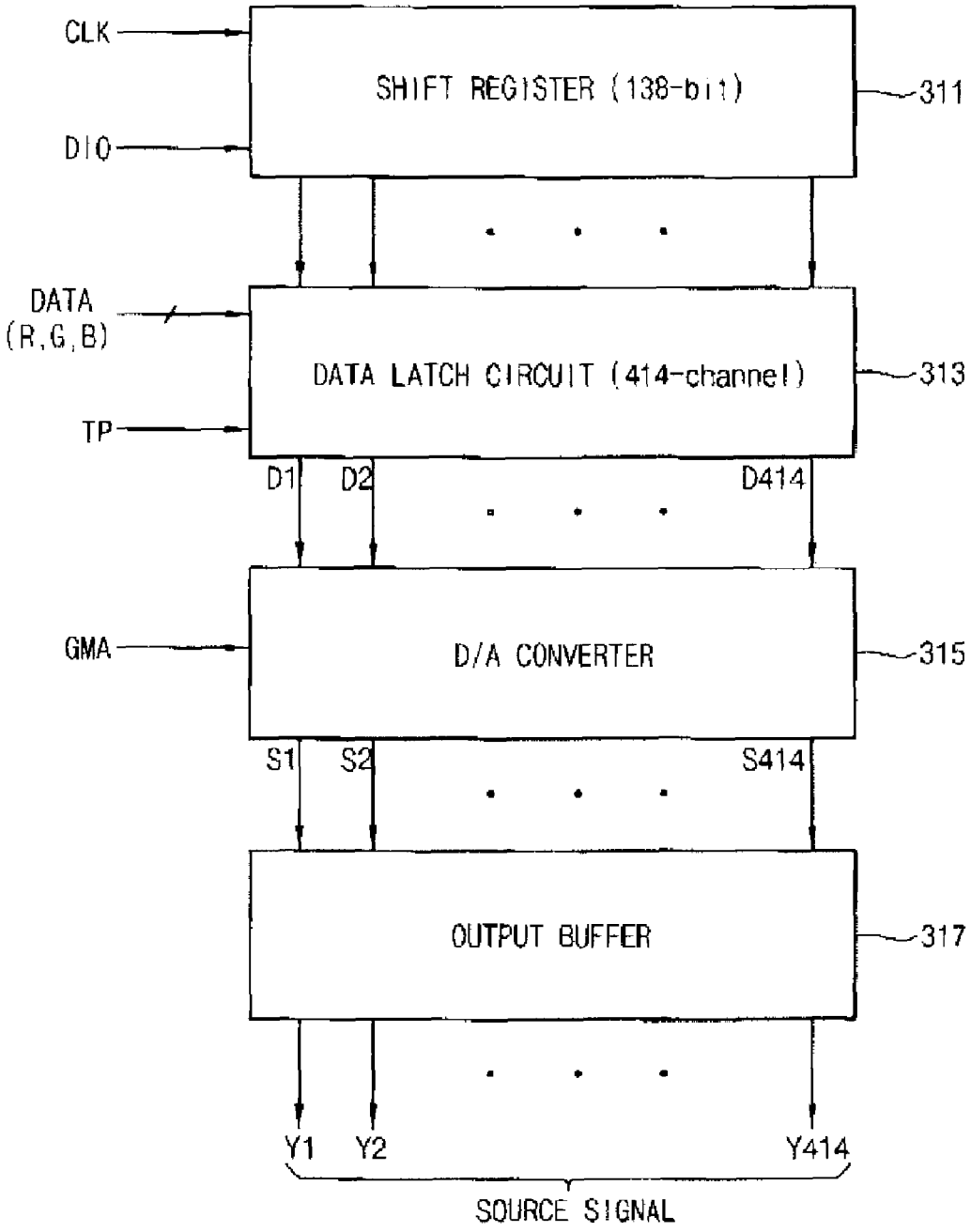
FIG. 3 (PRIOR ART)
FIG. 3 is a block diagram of one source drive IC of the source driving circuit illustrated in FIG. 2.

The liquid crystal display device including the source driver 1310 may have the same configuration as that of the liquid crystal display device of FIG. 1. Although the above descriptions of example embodiments of the present invention discuss the liquid crystal display device, it is to be understood that the source driver circuit could be applied to organic light emitting diode display devices or any other display device. It is to be understood that the source driving circuit configured to generate the 414 source signals, as described above may be embodied to generate an arbitrary number of source signals.

The source driving circuit according to example embodiments of the present invention may consume less power than a conventional source driving circuit.

Although example embodiments of the present invention have been described in detail with reference to the accompanying drawings for the purpose of illustration and description, it is to be understood that the inventive processes and apparatus are not to be construed as limited thereby. It will be apparent to those of ordinary skill in the art that various modifications to the foregoing example embodiments may be made without departing from the scope of the invention as defined by the appended claims, with equivalents of the claims to be included therein.

What is claimed is:

1. A source driving circuit of a display device, comprising:

a shift register configured to generate an n-bit first signal in response to a clock signal and an input/output control signal;

a data latch circuit configured to sample video data using the first signal to latch the sampled video data, and configured to output 3.times.n digital signals;

a D/A converter configured to generate a plurality of analog voltage signals corresponding to the 3.times.n digital signals using a plurality of gray scale voltages; and a sample-and-hold circuit configured to generate 6.times.n sample-and-hold signals using the analog voltage signals in response to a plurality of switching control signals, wherein n is a positive integer, wherein the sample-and-hold circuit comprises:

a buffer circuit configured to buffer the analog voltage signals;

a switching circuit configured to output the buffered signals of the buffer circuit in response to the switching control signals; and a storage circuit configured to store the output signals of the switching circuit, wherein the switching circuit comprises:

a plurality of MOS transistors; and a plurality of MOS capacitors respectively coupled between the storage circuit and gates of the MOS transistors.

2. The source driving circuit of claim 1, wherein the data latch circuit outputs the 3.times.n digital signals in response to a load signal.

3. The source driving circuit of claim 1, wherein the buffer circuit comprises a plurality of voltage followers.

4. The source driving circuit of claim 1, wherein the storage circuit comprises a plurality of capacitors.

5. The source driving circuit of claim 1, further comprising an output buffer configured to buffer the sample-and-hold signals to select the 3.times.n signals of the 6.times.n sample-and-hold signals, and configured to output the selected sample-and-hold signals as source signals.

6. The source driving circuit of claim 5, wherein the output buffer comprises:

a buffer circuit configured to buffer the signals; and a selecting circuit configured to select half of the output signals of the buffer circuit.

7. The source driving circuit of claim 6, wherein the selecting circuit comprises a plurality of multiplexers configured to receive two signals and select one of the two signals.

8. The source driving circuit of claim 1, further comprising a sample-and-hold controller configured to generate the switching control signals in response to a sample-and-hold control signal.

9. The source driving circuit of claim 1, further comprising a gray scale voltage generator configured to generate the gray scale voltages.

10. A display device comprising:

a controller configured to generate a plurality of gate control signals, a clock signal, a plurality of input/output control signals, a load signal, and a sample-and-hold control signal;

a gate driving circuit configured to generate a plurality of gate signals in response to the gate control signals and configured to supply the gate signals to gate lines of a display panel; and a source driving circuit, wherein the source driving circuit comprises:

a shift register configured to generate an n-bit first signal in response to the clock signal and the input/output control signal; a data latch circuit configured to sample video data using the first signal to latch the sampled video data, and configured to output 3.times.n digital signals;

a D/A converter configured to generate a plurality of analog voltage signals corresponding to the 3.times.n digital signals using gray scale voltages; and a sample-and-hold circuit configured to generate 6.times.n second signals using the analog voltage signals in response to a plurality of switching control signals, wherein n is a positive integer, wherein the sample-and-hold circuit comprises:

a buffer circuit configured to buffer the analog voltage signals;

a switching circuit configured to output the buffered signals of the buffer circuit in response to the switching control signals; and a storage circuit configured to store the output signals of the switching circuit wherein the switching circuit comprises:

a plurality of MOS transistors; and a plurality of MOS capacitors respectively coupled between the storage circuit and gates of the MOS transistors.

11. The display device of claim 10, wherein the source driving circuit further comprises an output buffer configured to buffer the sample-and-hold signals and select the 3.times.n sample-and-hold signals of the 6.times.n sample-and-hold second signals, and output the selected sample-and-hold signals as source signals.

12. The display device of claim 10, wherein the data latch circuit outputs the 3.times.n digital signals in response to the load signal.

13. The display device of claim 10, wherein the source driving circuit further comprises a sample-and-hold controller configured to generate the switching control signals in response to a sample-and-hold control signal.

14. The display device of claim 10, wherein the source driving circuit further comprises a gray scale voltage generator configured to generate the gray scale voltages.

15. A sample-and-hold circuit comprising:

a buffer circuit configured to buffer 3×n analog voltage signals;

a switching circuit configured to generate 6×n signals using the buffered signals of the buffer circuit in response to a plurality of switching control signals; and a storage circuit configured to store the output signals of the switching circuit, wherein n is a positive integer, wherein the switching circuit comprises:

a plurality of MOS transistors; and a plurality of MOS capacitors respectively coupled between the storage circuit and gates of the MOS transistors.

16. The sample-and-hold circuit of claim 15, wherein the buffer circuit comprises a plurality of voltage followers and wherein the storage circuit comprises a plurality of capacitors.

* * * * *